US005925276A

United States Patent [19]

Batliwalla et al.

[11] Patent Number: 5,925,276

[45] Date of Patent: Jul. 20, 1999

[54] CONDUCTIVE POLYMER DEVICE WITH FUSE CAPABLE OF ARC SUPPRESSION

[75] Inventors: Neville S. Batliwalla, Foster City; Arthur F. Emmett, Sunnyvale; Brian S. Larkin, Moss Beach, all of Calif.

[73] Assignee: Raychem Corporation, Menlo Park, Calif.

[21] Appl. No.: 08/471,893

[22] Filed: Jun. 7, 1995

Related U.S. Application Data

[63] Continuation of application No. 07/666,760, Mar. 8, 1991, abandoned, which is a continuation-in-part of application No. 07/579,757, Sep. 10, 1990, abandoned, and application No. 07/618,572, Nov. 27, 1990, abandoned, which is a continuation of application No. 07/404,730, Sep. 8, 1989, abandoned.

[51] Int. Cl.[6] ..... H05B 3/00

[52] U.S. Cl. ..... 219/553; 219/505; 219/544

[58] Field of Search ..... 219/504–505, 219/544, 553, 548–549; 338/22 R

[56] References Cited

U.S. PATENT DOCUMENTS

| | | | |
|---|---|---|---|
| Re. 31,017 | 8/1982 | Bernstein | 339/147 P |
| 3,760,495 | 9/1973 | Meyer | 29/610 |
| 3,858,144 | 12/1974 | Bedard et al. | 338/22 R |
| 3,861,029 | 1/1975 | Smith-Johannsen et al. | 29/611 |
| 4,006,443 | 2/1977 | Kouchich et al. | 338/215 |
| 4,017,715 | 4/1977 | Whitney et al. | 219/553 |
| 4,188,276 | 2/1980 | Lyons et al. | 204/159.17 |
| 4,237,441 | 12/1980 | Van Konynenburg et al. | 338/22 R |
| 4,242,573 | 12/1980 | Batliwalla | 219/528 |
| 4,334,148 | 6/1982 | Kampe | 219/553 |
| 4,334,351 | 6/1982 | Sopory | 29/611 |
| 4,343,733 | 8/1982 | Maringer et al. | 524/87 |

(List continued on next page.)

FOREIGN PATENT DOCUMENTS

| | | |
|---|---|---|
| 197745 | 10/1986 | European Pat. Off. . |
| 312485 | 4/1989 | European Pat. Off. . |
| 59-096148 | 6/1984 | Japan . |
| 4-94081 | 3/1992 | Japan . |
| 4-264382 | 9/1992 | Japan . |
| 7306653 | 11/1974 | Netherlands . |
| 407 543 | 8/1966 | Switzerland . |
| 1560759 | 2/1980 | United Kingdom . |

OTHER PUBLICATIONS

Reference Standard for Electrical Wires, Cables, and Flexible Cords—UL 1581, § 1080, VW–1 (Vertical Wire) Flame Test, Aug. 8, 1985.

Bulletin SFB, "Buss Small Dimension Fuses", May 1985 (McGraw Edison).

Elektrotechnik (Bundesrepublik Deutschland), p. 383.

*Encyclopedia of Polymer Science and Engineering*, vol. 7, pp. 187–190, John Wiley & Sons, 1985.

Jürgen Troitzsch, *Brandverhalten von Kunststoffen, Grundlagen, Vorschriften, Prüfverfahren*, Beenken et al, pp. 50, 60, 61, Carl Hanser Verlag, 1982.

*Taschenbuch der Kunstoff–Additive*, Gächter and Müller, pp. 765,.767, Carl Hanser Verlag, 1990.

(List continued on next page.)

*Primary Examiner*—John A. Jeffery

*Attorney, Agent, or Firm*—Marguerite E. Gerstner; Herbert G. Burkard; Timothy H. P. Richardson

[57] ABSTRACT

A melt-extrudable conductive polymer composition which contains a polymer, a particulate conductive filler, and a particulate nonconductive filler. When a standard strip heater is made from the composition and tested in a UL VW-1 test, it has comparable performance to a heater made from a second composition which is the same as the composition but which does not contain the nonconductive filler. When tested in a standard arcing fault test, the standard heater will trip a fuse in less time than is required by the second heater, i.e. in less than 30 seconds. In some embodiments, the composition also comprises a flame retardant, preferably a halogenated flame retardant. When strip heaters prepared from these compositions are tested in a standard arc propagation test, an arc will not propagate. A preferred nonconductive filler is $Sb_2O_3$.

24 Claims, 2 Drawing Sheets

U.S. PATENT DOCUMENTS

| | | | |
|---|---|---|---|
| 4,344,058 | 8/1982 | Knapp et al. | 337/148 |
| 4,348,584 | 9/1982 | Gale et al. | 219/544 |
| 4,388,607 | 6/1983 | Toy et al. | 338/22 SD |
| 4,425,497 | 1/1984 | Leary et al. | 219/544 |
| 4,426,339 | 1/1984 | Kamath et al. | 264/22 |
| 4,436,986 | 3/1984 | Carlson | 219/505 |
| 4,459,473 | 7/1984 | Kamath | 219/553 |
| 4,514,620 | 4/1985 | Cheng et al. | 219/553 |
| 4,534,889 | 8/1985 | Van Konynenburg et al. | 252/511 |
| 4,550,301 | 10/1985 | McTavish et al. | 338/22 R |
| 4,555,539 | 11/1985 | Bonicel et al. | 524/127 |
| 4,560,498 | 12/1985 | Horsma et al. | 252/511 |
| 4,591,700 | 5/1986 | Sopory | 219/553 |
| 4,629,869 | 12/1986 | Bronvall | 219/553 |
| 4,679,877 | 7/1987 | Ahroni | 439/425 |
| 4,742,212 | 5/1988 | Ishii et al. | 219/549 |
| 4,758,184 | 7/1988 | Call | 439/622 |
| 4,775,778 | 10/1988 | Van Konynenburg et al. | 219/549 |
| 4,800,253 | 1/1989 | Kleiner et al. | 219/553 |
| 4,822,983 | 4/1989 | Bremner et al. | 219/504 |
| 4,849,133 | 7/1989 | Yoshida et al. | 219/553 |
| 4,910,389 | 3/1990 | Sherman et al. | 219/549 |
| 4,980,541 | 12/1990 | Shafe et al. | 219/548 |
| 5,002,501 | 3/1991 | Tucker | 439/417 |
| 5,004,432 | 4/1991 | Tucker | 439/417 |
| 5,045,673 | 9/1991 | Kelly | 219/553 |
| 5,081,339 | 1/1992 | Stine | 219/504 |
| 5,111,032 | 5/1992 | Batliwalla et al. | 219/549 |

OTHER PUBLICATIONS

*Kunststoff–Handbuch*, "Polyolefine", vol. IV, Vieweg et al, pp. 728–729, 1979.

Jügen Troitzsch, *Brandverhalter von Kunststoffen, Grundlagen, Vorschriften, Prüfverfahren*, Beenken et al, pp. 47–48 (chapter 5.1.1) and 55, Carl Hanser Verlag, 1982.

CONDUCTIVE POLYMER DEVICE WITH FUSE CAPABLE OF ARC SUPPRESSION

CROSS-REFERENCE TO RELATED APPLICATIONS

This application is a continuation of a continuation-in-part of commonly assigned application Ser. No. 07/666,760, filed Mar. 8, 1991, now abandoned, which is a continuation-in-part of copending commonly assigned applications Ser. Nos. 07/579,757, filed Sep. 10, 1990 (Batliwalla et al), now abandoned, and 07/618,572, filed Nov. 27, 1990 (Emmett), now abandoned which is a continuation of application Ser. No. 07/404,730, filed Sep. 8, 1989, now abandoned, the disclosure of each of which is incorporated herein by reference.

BACKGROUND OF THE INVENTION

1. Field of the Invention

This invention relates to conductive polymer compositions and strip heaters comprising them, in particular self-regulating strip heaters which comprise a pair of elongate metal electrodes embedded in an elongate core of a conductive polymer composition which exhibits PTC behavior.

2. Introduction to the Invention

Conductive polymer compositions and self-regulating strip heaters which comprise conductive polymer compositions are well known. A conductive polymer composition comprises a polymeric component and, dispersed or otherwise distributed therein, a particulate conductive filler. For most applications, such strip heaters comprise a resistive element composed of a conductive polymer having elongate electrodes embedded therein. Generally, the resistive element is surrounded by an insulating jacket to provide electrical insulation and environmental protection. In operation, these heaters can be wrapped around or attached to a substrate, e.g. a pipe or a tank, and provide a varying level of heat in response to changes in the thermal environment. Under normal operating conditions, this self-regulating feature serves to limit the maximum temperature which the heater achieves, thus providing safety and reliability. However, where the electrodes are exposed by external damage or by faulty installation, and when the heater is electrically powered and exposed to an electrolyte, in some circumstances an arc can occur between the electrodes. If the heater remains powered, the arc can under some circumstances "propagate", i.e. progress down the length of the strip, prolonging the burning.

Various solutions to this problem have been proposed, including the use of polymers which are themselves flame-retarded and the use of conductive polymer compositions which comprise flame-retardant additives, and the use of circuit protection devices such as arc fault interrupters or ground fault interrupters which remove power from the circuit in the event of an arc. Copending, commonly assigned application Ser. No. 07/519,701 (Batliwalla et al), filed May 7, 1990, now abandoned in favor of a continuation-in-part application, application Ser. No. 08/211,829, filed Nov. 6, 1992, the disclosure of which is incorporated herein by reference, discloses the use of an additional insulating jacket over the resistive element in order to reduce the flammability of the heater.

SUMMARY OF THE INVENTION

We have now discovered that the presence of a nonconductive filler in the conductive polymer composition in a strip heater can reduce the trip time of a fuse which forms part of a strip heater circuit, and thus reduce the danger that an arc will form and cause damage. We have further discovered that when a conductive polymer composition comprises a mixture of a nonconductive filler and a flame retardant, it can be used to make a heater which can have a a reduced tendency to propagate arcs. In a first aspect, this invention relates to a melt-extrudable conductive polymer composition which comprises (1) a polymer, (2) a particulate conductive filler, and (3) a particulate nonconductive filler, and which further comprises one of the following features (A) said first composition being such that when the first composition is made into a standard strip heater I as defined below (i) when the standard heater I is tested following the procedure of UL test VW-1 its performance is similar to a second heater which is made from a second conductive polymer composition which is the same as the first composition except that it does not comprise the particulate nonconductive filler, and (ii) when the standard heater is tested in a standard arcing fault test as defined below (a) the time it requires to trip a fuse is less than the time required to trip a fuse for the second heater, and (b) it trips the fuse in less than 30 seconds;

(B) said first composition being such that when the first composition is made into a standard strip heater I (i) when the standard heater I is tested following the procedure of UL test VW-1 it does not pass the test, and (ii) when the standard heater I is tested in a standard arcing fault test (a) the time it requires to trip a fuse is less than the time required to trip a fuse for a second heater which is made from a second conductive polymer composition which is the same as the first composition except that it does not comprise the particulate nonconductive filler, and (b) it trips the fuse in less than 30 seconds;

(C) said first composition being such that (a) it further comprises a flame retardant, and (b) when it is made into a standard strip heater II as defined below and the standard strip heater II is tested in a standard arc propagation test as defined below, an arc will not propagate.

In a second aspect, this invention relates to a heater which may be prepared from a composition of the first aspect and which comprises a composition as defined in the first aspect of the invention and which further comprises one of the following features (A) when tested (1) following the procedure of UL VW-1, the heater has a performance which is similar to that of a second heater made from a second conductive polymer composition which is the same as the first composition except that it does not comprise the particulate nonconductive filler, and (2) in a standard arcing fault test (i) trips the fuse in less time than is required by the second heater, and (ii) trips the fuse in less than 30 seconds;

(B) when tested (1) following the procedure of UL VW-1, does not pass the test, and (2) in a standard arcing fault test (i) trips the fuse in less time than is required by a second heater made from a second conductive polymer composition which is the same as the first composition which is the same as the first composition except that it does not comprise the particulate nonconductive filler, and (ii) trips the fuse in less than 30 seconds;

(C) the conductive polymer composition further comprises a flame retardant and when the conductive polymer composition is made into a standard strip heater II and the standard strip heater II is tested in a standard arc propagation test, an arc will not propagate.

In a third aspect, this invention relates to a strip heater circuit which comprises (1) a strip heater which comprises (a) a resistive element which is composed of a conductive polymer composition which comprises (i) a polymer, (ii) a particulate conductive filler, and (iii) a particulate nonconductive filler, and (b) two electrodes which can be connected to a source of electrical power to cause current to flow through the resistive element, and (2) a power supply, and which further comprises one of the following features (A) the circuit further comprises a fuse and the particulate nonconductive filler is such that when the composition is made into a standard strip heater I and the standard strip heater I is tested in a standard arcing fault test, it trips the fuse in less than 30 seconds;

(B) the conductive polymer composition further comprises a flame retardant and the heater is such that when tested in a standard arc propagation test, it will not propagate an arc; and (C) the conductive polymer composition further comprises a flame retardant and the conductive polymer composition is such that when it is made into a standard strip heater II and the standard strip heater II is tested in a standard arc propagation test, an arc will not propagate.

In a fourth aspect, this invention relates to a strip heater assembly which comprises (A) a strip heater which comprises (1) a resistive element which is composed of a first conductive polymer composition which comprises (a) a polymer, (b) a particulate conductive filler, and (c) a particulate nonconductive filer, and (2) two electrodes which can be connected to a source of electrical power to cause current to flow through the resistive element, and (B) a fuse, the particulate nonconductive filler being such that when the first composition is made into a standard strip heater I and the standard heater I is tested in a standard arcing fault test it trips the fuse in less than 30 seconds.

DETAILED DESCRIPTION OF THE INVENTION

Figure 1:
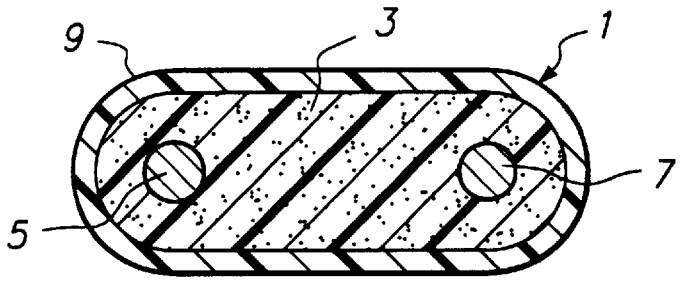
FIG. 1 is a cross-sectional view of a standard strip heater of the invention.

The first conductive polymer composition used in this invention comprises an organic polymer (such term being used to include polysiloxanes), preferably a crystalline organic polymer, an amorphous thermoplastic polymer (such as polycarbonate or polystyrene), an elastomer (such as polybutadiene or ethylene/propylene/diene (EPDM) polymer), or a blend comprising one or more of these. Suitable crystalline polymers include polymers of one or more olefins, particularly polyethylene; copolymers of at least one olefin and at least one monomer copolymerisable therewith such as ethylene/acrylic acid, ethylene/ethyl acrylate, and ethylene/vinyl acetate copolymers; melt-shapeable fluoropolymers such as polyvinylidene fluoride and copolymers of ethylene and tetrafluoroethylene and optionally one or more comonomers; polyesters; polyamides; and blends of two or more such crystalline polymers. Such crystalline polymers are particularly preferred when it is desired that the composition exhibit PTC (positive temperature coefficient of resistance) behavior. The term "PTC behavior" is used in this specification to denote a composition or an electrical device which has an $R_{14}$ value of at least 2.5 and/or an $R_{100}$ value of at least 10, and it is particularly preferred that the composition should have an $R_{30}$ value of at least 6, where $R_{14}$ is the ratio of the resistivities at the end and the beginning of a 14° C. temperature range, $R_{100}$ is the ratio of the resistivities at the end and the beginning of a 100° C. range, and $R_{30}$ is the ratio of the resistivities at the end and the beginning of a 30° C. range. Suitable polymers and compositions comprising them may be found in U.S. Pat. No. 4,188,276 (Lyons et al), U.S. Pat. No. 4,388,607 (Toy et al), U.S. Pat. No. 4,514,620 (Cheng et al), U.S. Pat. No. 4,534,889 (van Konynenburg et al), U.S. Pat. No. 4,560,498 (Horsma et al), U.S. Pat. No. 4,591,700 (Sopory), U.S. Pat. No. 4,775,778 (van Konynenburg et al), and U.S. Pat. No. 4,980,541 (Shafe et al); and copending commonly assigned U.S. application Ser. No. 07/114,488 filed Oct. 28, 1987 (Blake et al). Heaters comprising conductive polymer compositions are described in U.S. Pat. No. 3,858,144 (Bedard et al), U.S. Pat. No. 3,861,029 (Smith-Johannsen et al), U.S. Pat. No. 4,017,715 (Whitney et al), U.S. Pat. No. 4,242,573 (Batliwalla), U.S. Pat. No. 4,334,148 (Kampe), U.S. Pat. No. 4,334,351 (Sopory), U.S. Pat. No. 4,425,497 (Leary), U.S. Pat. No. 4,426,339 (Kamath et al), U.S. Pat. No. 4,459,473 (Kamath), and copending commonly assigned U.S. application Ser. No. 07/322,969 filed Mar. 13, 1989 (Batliwalla et al), now U.S. Pat. No. 5,111,032 and U.S. application Ser. No. 07/519,701 filed May 7, 1990 (Batliwalla et al), now abandoned in favor of a continuation-in-part application, application Ser. No. 08/211,829, filed Nov. 6, 1992. The disclosure of each of these patents, publications, and applications is incorporated herein by reference.

The composition also comprises a particulate conductive filler which is dispersed or otherwise distributed in the polymer. The particulate conductive filler may be, for example, carbon black, graphite, metal, metal oxide, particulate conductive polymer, or a combination of these. The particulate conductive filler is present in the composition in an amount suitable for achieving the resistivity needed for the desired application. For many applications, a particularly preferred particulate conductive filler is carbon black. If the composition is to be used in a strip heater, the carbon black normally comprises 5 to 50% by weight of the composition, preferably 10 to 40% by weight of the composition, particularly 15 to 30% by weight of the composition. Larger quantities of carbon black may be required for use in applications requiring lower resistivities, e.g. circuit protection devices.

The particulate nonconductive filler comprises a material which is electrically insulating, i.e. has a resistivity of greater than $1\times10^9$ ohm-cm. Preferably the nonconductive filler has a melting temperature of less than 1000° C. Suitable materials include metal oxides, particularly those which are easily reduced, e.g. $Sb_2O_3$, $Sb_2O_5$, $BaO_3$, $PbO_2$, $MoO_3$, $Bi_2O_3$, and NaSbO3. In this application, easily reduced means that the material has a reduction potential of less than +0.5 volts, preferably less than +0.4 volts, particularly less than +0.375 volts. For ease of dispersion in the polymer matrix, the filler is preferably in the form of particles which have a particle size of 0.01 to 50 $\mu$m, particularly 0.05 to 50 $\mu$m, especially 0.10 to 10 $\mu$m. The nonconductive filler may be a single material or it may comprise two or more materials, e.g. a blend of metal oxides or a blend of a metal oxide and another particulate filler. A particularly preferred nonconductive filler is $Sb_2O_3$. Compositions which are particularly effective are those which comprise both carbon black and $Sb_2O_3$ and in which the quantity (y)/(x+y) is at least 0.01, preferably at least 0.02, particularly at least 0.05, especially at least 0.10, e.g. 0.20 to 0.50, where x is the percent by weight of the carbon black and y is the percent by weight of the $Sb_2O_3$, based on the weight of the total composition. For compositions in which the polymer comprises a mixture of medium density polyethylene and ethylene/ethyl acrylate, the $Sb_2O_3$ is present in an amount at least 5%, preferably at least 7%, particularly at least 8%, the percentages being by weight of the total composition.

The composition used in some aspects of this invention also comprises a flame retardant which may be added to the composition in any suitable form, e.g. a particulate filler or a liquid. The flame retardant is preferably a halogenated material. Particularly preferred is decabromodiphenyloxide (also known as decabromodiphenylether), referred to herein as DBDPO. Compositions which are particularly effective are those which comprise both DBDPO and $Sb_2O_3$, and in which the quantity (y)/(y+z) is at least 0.10, preferably at least 0.15, particularly at least 0.20, e.g. 0.25 to 0.35, where z is the percent by weight of the DBDPO, based on the weight of the total composition.

The conductive polymer composition may also comprise inert fillers, antioxidants, chemical crosslinking agents, radiation crosslinking enhancement additives (prorads), stabilizers, dispersing agents, or other components. Mixing is preferably effected by melt-processing, e.g. melt-extrusion or processing in a Banbury or other internal mixer. Subsequent processing steps may include extrusion, molding, sintering, or another procedure in order to form and shape the composition. The composition may be crosslinked, e.g. by irradiation or chemical means.

The conductive polymer composition may be used in any current-carrying electrical device, e.g. a circuit protection device, a sensor, or, most commonly, a heater. The heater may be in the form of either a strip or a laminar sheet in which the resistive element comprises the composition of the invention. Strip heaters may be of any cross-section, e.g. rectangular, elliptical, or dumbbell ("dogbone"). Appropriate electrodes, suitable for connection to a source of electrical power, are selected depending on the shape of the electrical device. Electrodes may comprise elongate metal wires or braid, e.g. for attachment to or embedment in the conductive polymer, or they may comprise metal sheet, metal mesh, conductive (e.g. metal- or carbon-filled) paint, or other suitable materials.

In order to provide environmental protection and electrical insulation, it is common for the resistive element to be covered by a dielectric layer, e.g. a polymeric jacket (for strip heaters) or an epoxy layer (for circuit protection devices). The dielectric layer may comprise flame retardants or other fillers. For some strip heater applications, a metallic grounding braid is present over the dielectric layer in order to provide physical reinforcement and a means of electrically grounding the strip heater.

The compositions of this invention are particularly useful when, in the form of strip heaters, they are used in conjunction with a fuse and act to "trip" the fuse faster than strip heaters comprising conventional materials. A fuse "trips" when the current in the circuit comprising the fuse exceeds the rated value of the fuse. Fuses are categorized based on their overload fusing characteristics, i.e. the relationship between the value of current through the fuse and the time for the fuse to open, as described in Bulletin SFB, "Buss Small Dimension Fuses", May 1985, the disclosure of which is incorporated herein by reference. Of the major categories (slow blowing, non-delay, and very fast acting), it is very fast acting fuses which are most useful in this invention. These fuses have little, if any, intentional delay in the overload region. Although the selection of a specific fuse is dependent on the normal operating conditions of the strip heater and the anticipated fault conditions, fuses which are particularly preferred are very fast-acting ceramic ferrule fuses with a current rating of 10 amperes and a voltage rating of 125/250 volts. Such fuses are available, for example, from the Bussman Division of Cooper Industries under the name Buss GBB™-10.

Strip heaters of one aspect of the invention are commonly used in a strip heater assembly which comprises the strip heater and a fuse. Alternatively, the strip heater is a component of a strip heater circuit which comprises the strip heater and a power supply. The power supply can be any suitable source of power, including portable power supplies and mains power sources. Other components such as resistors, thermostats, circuit protection devices, and indicating lights may also be present in the circuit. When the circuit incorporates a fuse, such as one described above, or a slow-blow fuse, e.g. a standard glass-encapsulated fuse such as that available from the Bussman Division of Cooper Industries under the name Bussman™ 312 which has a rating of 250 volts/10 amps, the fuse may be an independent component in the circuit or it may be in a fused plug assembly, i.e. an assembly in which the fuse is part of the plug which connects the strip heater to the power source, e.g. an outlet or a power supply. Examples of fused plugs of this type, which preferably comprise very fast acting fuses, are found in copending, commonly assigned application Ser. Nos. 07/415,757 and 07/415,820, both filed Oct. 2, 1989 (Tucker), now U.S. Pat. No. 5,002,501 (issued Mar. 26, 1991) and U.S. Pat. No. 5,004,432 (issued Apr. 2, 1991), the disclosures of which are incorporated herein by reference.

In this specification, a "standard strip heater" is defined for testing purposes. A "standard strip heater I" is defined for use in determining performance in a "standard arcing fault test", as later defined. A standard strip heater I is one in which a conductive polymer composition is melt-extruded around two 22 AWG stranded nickel/copper wires to produce a strip heater of flat, elliptical shape as shown in FIG. 1. The standard heater has an electrode spacing of 0.10 inch (0.25 cm) from the center of one electrode to the center of the second electrode. The thickness of the standard heater at a point centered between the electrodes is 0.08 inch (0.20 cm). The standard heater is jacketed with a 0.030 inch (0.076 cm) thick layer of the flame-retarded composition used for the jacket material in Example 1. A "standard strip heater II" is defined for use in a "standard arc propagation test" as defined below. A standard strip heater II is one in which a conductive polymer composition is extruded and jacketed as in the standard strip heater I to produce a strip heater which has an electrode spacing of 0.10 inch (0.25 cm) and a thickness of 0.07 inch (0.18 cm). For most applications, there will be no difference in performance between standard strip heater I and standard strip heater II when tested in any of the three defined tests.

The standard strip heater is tested by means of a standard arcing fault test. In this test, which is fully described below, a standard strip heater I is connected in a circuit to a power supply and a 10 A, 125/250V fuse. An arc is initiated between two exposed electrodes of the heater and the time to interrupt the current and extinguish the arc by means of tripping the fuse is recorded. We have found that a standard strip heater I which comprises the composition of the invention (i.e. a first conductive polymer composition) trips the fuse faster than a second strip heater which has the same geometry as the standard strip heater I and which comprises a second conductive polymer composition, i.e. a composition which is the same as the first composition except that it does not comprise the nonconductive particulate filler. The time to trip a fuse for the standard heater I generally will be at least two times as fast, preferably at least three times as fast, particularly at least five times as fast, e.g. five to eight times as fast as the second heater. Thus the standard heater I will trip the fuse in at most half the time required to trip the fuse in a circuit which comprises a second heater. When tested in the standard arcing fault test, a standard strip heater I of the invention normally will trip the fuse in less than 30 seconds, preferably in less than 25 seconds, particularly in less than 20 seconds, e.g. in 5 to 10 seconds. An additional aspect of the invention is that the addition of the nonconductive particulate filler results in an increase in the number of current spikes observed during the arcing fault test. Even if the amplitude of the spikes is similar for both types of heaters, there generally will be at least 2 times, preferably at least 3 times, particularly at least 4 times as many current spikes in a given period, e.g. 30 seconds, for the heater comprising the first composition.

A second test which is conducted on heaters comprising the first composition of the invention is the UL VW-1 vertical-wire flame test (Reference Standard for electrical Wires, Cables, and Flexible Cords, UL 1581, No. 1080, Aug. 15, 1983, the disclosure of which is incorporated herein by reference). In this test, a heater sample is held in a vertical position while a flame is applied. In order to pass the test, the sample cannot "flame" longer than 60 seconds following any of five 15-second applications of the test flame. The period between sequential applications of the test flame is either 15 seconds (if the sample ceases flaming within 15 seconds) or the duration of the sample flaming time if the flaming lasts longer than 15 seconds. In addition, combustible materials in the vicinity of the sample cannot be ignited by the sample during the test. In this specification, when the performance in this test of the heater of the invention is said to be "similar" to that of a second heater which comprises a second conductive polymer composition, it means that if ten different samples of the heater of the invention are tested, eight of them (i.e. 80%) must have the same result (i.e. pass or fail) as ten samples of the second composition.

In this specification, an arc is defined to be "non-propagating" if, in a standard arc propagation test as described below, it extinguishes itself, i.e. puts itself out, in less than 20 seconds from the time of arc initiation, or if it propagates a distance of less than 0.25 inch (0.64 cm), preferably less than 0.125 inch (0.32 cm), beyond the arc initiation point. In the "standard arc propagation test", which is fully described below, a strip heater is connected in a circuit to a power supply and the behavior of any arc which is initiated is observed visually and electrically by means of a chart recorder connected across the circuit. Heaters are determined to be non-propagating either if no arc can be initiated despite multiple applications of electrolyte, or if the arc extinguishes itself in less than 20 seconds from the time of arc initiation. We have obtained similar results when the arc is initiated by an external flame rather than by an electrolyte.

While we do not wish to be bound to any particular theory to explain the operation of heaters of this invention when tested in the standard arc propagating test, the experimental data are consistent with the following sequence. The non-conductive filler, preferably $Sb_2O_3$, acts as a catalyst to oxidize the carbon black in the conductive polymer with the resulting evolution of $CO_2$ and the elimination of carbon tracking paths. Concurrently, the $Sb_2O_3$ is reduced to antimony metal which is conductive and creates a low resistance path through the polymer. In addition, the flame retardant, preferably DBDPO, acts synergistically with the $Sb_2O_3$ to extinguish any flame which may liberate more carbon and result in more carbon tracks.

Figure 2:
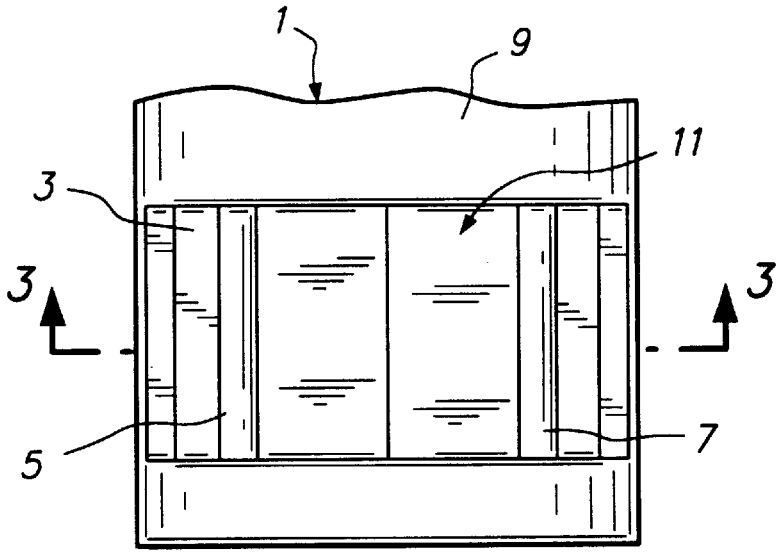
FIG. 2 is a top view of a strip heater of the invention.
Figure 3:
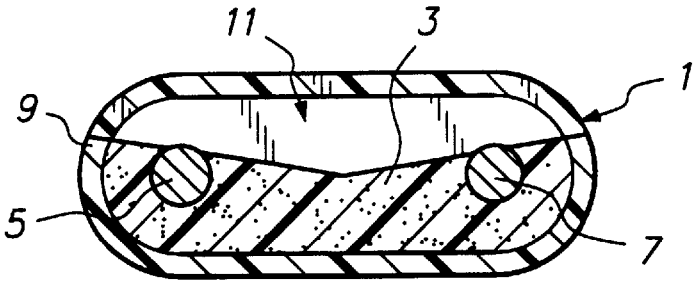
FIG. 3 is a cross-sectional view of a strip heater along line 3—3 of FIG. 2.

The invention is illustrated by the drawing in which FIG. 1 shows a cross-section of a standard strip heater (either form I or II) 1. Electrodes 5,7 are embedded in the conductive polymer composition 3 which provides the resistive element. A polymeric jacket 9 surrounds the heater core. FIG. 2 shows a top view of strip heater 1 which has been prepared for the standard arc faulting test or the standard arc propagation test described below. A V-shaped notch 11 is cut through the polymeric jacket 9 and the conductive polymer composition 3 on one surface of the heater in order to expose electrodes 5 and 7. The cross-sectional view of the prepared heater along line 3—3 is shown in FIG. 3. Electrodes 5,7 remain partially embedded in the conductive polymer 3.

Figure 4:
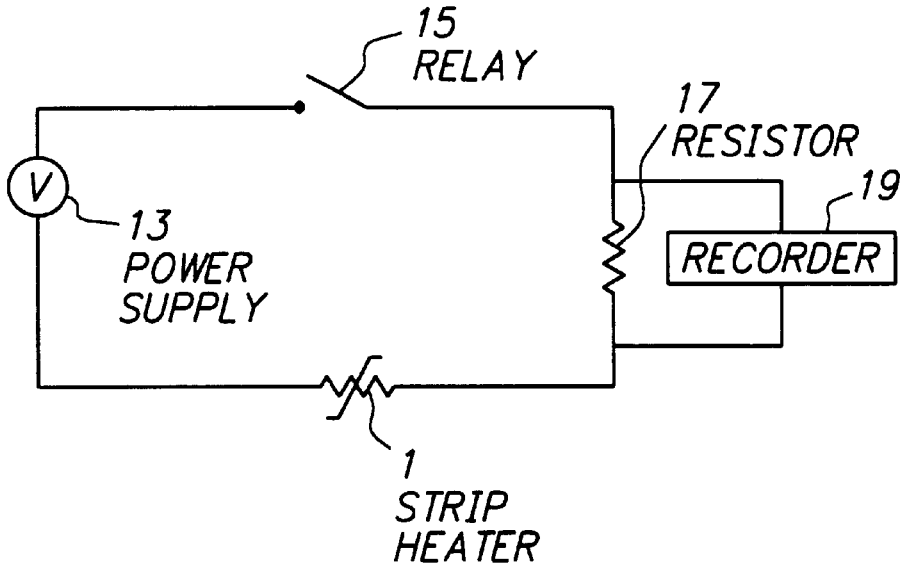
FIG. 4 is a circuit diagram of a circuit of the invention.

FIG. 4 shows a circuit of the invention which is equivalent to the standard arc propagation test circuit defined below. A strip heater 1 is connected electrically in series with a power supply 13, a contact relay 15, and a shunt resistor 17. A chart recorder 19 is connected across the shunt resistor 17 and is used to measure the voltage drop when the contact relay 15 is closed and voltage flows through the circuit. A similar circuit may be used to conduct the standard arcing fault test if a very fast acting fuse is also connected in series in the circuit.

Figure 5:
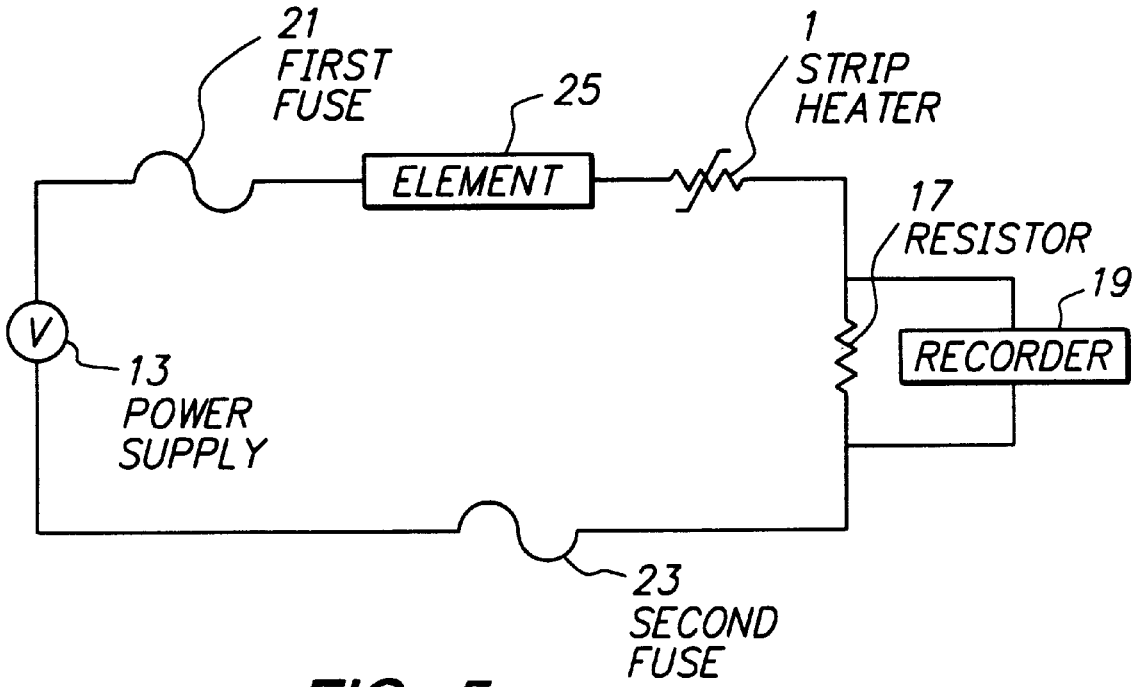
FIG. 5 is a circuit diagram of a circuit of the invention.

FIG. 5 shows a circuit of the invention in which strip heater 1 is connected electrically in series with power supply 13, shunt resistor 17, first fuse 21 (which may be part of a fused plug), and second fuse 23. Chart recorder 19 is connected across shunt resistor 17. Also present in the circuit is element 25 which may be a resistor, a thermostat, a circuit protection device, or an indicating light.

The invention is illustrated by the following Examples. Heaters prepared according to the Examples were tested by using the standard arcing fault test or the standard arc propagation test.

Standard Arcing Fault Test

A jacketed 25 inch—(64 cm-) long strip heater in the geometry of standard strip heater I was prepared by stripping one inch (2.5 cm) of jacket and conductive polymer material from a first end to expose the two electrodes. A transverse v-shaped notch was cut half-way through the thickness of the heater 2 inches (5.1 cm) from the second end and the jacket and conductive polymer were removed from the top half of the heater in order to expose part of each of the two electrodes. The electrodes at the first end were connected in a circuit in series with a 120V/100 A power supply, a contactor relay, a 10 A, 125/250V very fast acting fuse (Buss GBB™-10, available from the Bussman Division of Cooper Industries), and a 0.1 ohm/100 watt shunt resistor. A chart recorder was connected across the shunt resistor in order to measure the voltage drop. When the relay was closed, the sample was powered at a voltage of 120 volts. A sufficient quantity of 10 to 20% saline solution was applied to the exposed v-notch to initiate an arcing fault. The chart recorder was monitored until the current was interrupted and the arc was extinguished (i.e. until the fuse tripped). Both the time duration of the arc, as determined from the current spikes on the chart, and the distance of arc fault propagation on the strip heater were measured. In some instances, the number of current spikes present during the arcing fault was also determined.

Standard Arc Propagation Test

A jacketed strip heater in the geometry of standard heater II was prepared as described in the standard arcing fault test. The electrodes at the first end of the heater were connected in a circuit in series with a 120V/100 A power supply, a contactor relay, and a 0.1 ohm/100 watt shunt resistor, as shown in FIG. 4. A chart recorder was connected across the shunt resistor in order to measure the voltage drop. When the relay was closed, the sample was powered at a voltage of 120 volts. A sufficient quantity of 10 to 20% saline solution was applied to the exposed v-notch to initiate an arcing fault. The chart recorder was monitored until the arc was extinguished. The distance of arc fault propagation on the strip heater, as well as the number and intensity of current spikes present during the arcing fault, was measured.

EXAMPLE 1 (COMPARATIVE EXAMPLE)

The components listed in for Example 1 in Table I were preblended and then mixed in a co-rotating twin screw extruder to form pellets. The pelletized composition was extruded through a 1.5 inch (3.8 cm) extruder around two 22 AWG stranded nickel/copper wires to produce a strip heater. The heater had an electrode spacing of 0.106 inch (0.269 cm) from wire center-to-wire center and a thickness of 0.083 inch (0.211 cm) at a center point between the wires. The heater was jacketed with a 0.030 inch (0.076 cm) layer of a composition containing 10% by weight ethylene/vinyl acetate copolymer (EVA), 36.8% medium density polyethylene, 10.3% ethylene/propylene rubber, 23.4% decabromo-diphenyloxide, 8.5% antimony oxide, 9.4% talc, 1.0% magnesium oxide, and 0.7% antioxidant, all percentages being by weight of the total composition.

The heater was tested using the standard arcing fault test. The results are shown in Table II. In a related test (the "modified arcing fault test"), the amplitude and frequency of the current spikes produced when a heater was tested following the procedure of the arcing fault test but without the use of a fuse were recorded. In this modified arcing fault test, the samples were allowed to burn for three minutes after a flame was initiated. The results are shown in Table III.

The heater was also tested following the procedures of the UL VW-1 vertical-wire flame test (Reference Standard for Electrical Wires, Cables, and Flexible Cords, UL 1581, No. 1080, Aug. 15, 1983). Of the ten samples tested, five passed the test. These results are shown in Table IV.

EXAMPLE 2 TO 6

For each example, pellets of the composition of Example 1 were preblended with the inorganic materials in the proportions shown in Table I. After mixing in a co-rotating twin screw extruder and pelletizing, the compositions were extruded to form strip heaters with the same geometry as that of Example 1 and were jacketed as in Example 1. The results of the arcing fault test and the vertical flame test are shown in Tables II and IV. It is apparent that those compositions which contain $Sb_2O_3$ have significantly faster trip times in the arc fault test than comparable materials which do not contain the filler.

A strip heater formed from the composition of Example 2 was also tested following the modified arcing fault test described in Example 1. As shown in the results in Table III, the amplitude of the current spikes and the burn rate were comparable for both the conventional composition (Example 1) and the composition of the invention (Example 2). The major difference occurred in the frequency of the current spikes; the spikes were much more prevalent for the composition of the invention than for the conventional material.

EXAMPLE 7

Following the procedure of Example 1, the ingredients listed for Example 7 in Table 1 were preblended, mixed, pelletized, and extruded over two 16 AWG 19-strand nickel-coated copper wire electrodes to produce a strip heater with a wire spacing of 0.285 inch (0.724 cm) wire center-to-wire center and a thickness of 0.057 inch (0.145 cm) at a position intermediate to the electrodes. The heater was jacketed with the same material as in Example 1. The results of testing are shown in Tables II and IV.

EXAMPLE 8

Pellets of the composition of Example 7 were blended with 11.7% by weight decabromodiphenyloxide and 4.3% $Sb_2O_3$ before extrusion into pellets. The pellets were extruded to form a strip heater as in Example 7. The results of testing are shown in Tables II and IV.

EXAMPLE 9 (COMPARATIVE EXAMPLE)

Following the procedure of Example 1, the ingredients listed for Example 9 in Table I were preblended, mixed, pelletized, and extruded around two 22 AWG stranded nickel-copper wires. The resulting strip heater had a relatively flat elliptical cross-section with an electrode spacing of 0.106 inch (0.269 cm), a thickness of 0.067 inch (0.170 cm), and a total width of about 0.172 inch (0.437 cm). The heater was jacketed as in Example 1.

The heater was tested using the Standard Arc Propagation Test previously described. The results of the testing of this Example and Examples 10 to 19 are shown in Table V. Also shown are the results of additional tests which were run for some samples which had a heater length (after stripping the conductive polymer from the end of the electrodes) of 100 feet (30.5 meters), or which were powered at voltages ranging from 60 to 120 volts. Similar information to that of the standard arc propagation test, e.g. distance of arc propagation, the number and intensity of current spikes, was recorded.

EXAMPLE 10

Following the procedure of Example 9, the ingredients listed for Example 10 in Table I were mixed, extruded, and jacketed to give a strip heater with the same dimensions as Example 9.

EXAMPLE 11

Pellets of the composition of Example 9 were pre-blended with a mixture of 26.9% by weight $Sb_2O_3$ and 73.1% by weight decabromodiphenyloxide (DBDPO) to give a blend with the composition shown for Example 11 in Table I. The blend was mixed in a co-rotating twin-screw extruder to form pellets and was then extruded and jacketed to produce a heater with the same dimensions as that in Example 9.

EXAMPLE 12

Sixty-eight pounds (30.9 kg) of the pellets of Example 9 were pre-blended with 32 pounds (14.5 kg) of the mixture of $Sb_2O_3$ and DBDPO described in Example 11 to give a blend with the same formulation as shown for Example 12 in Table I. The blend was mixed and extruded, and the heater was jacketed as in Example 11.

nickel-copper wires to produce a strip heater with a "dog-bone" cross-section. The heater had an electrode spacing of 0.108 inch (0.274 cm) from wire center to wire center, a "web" thickness of approximately 0.040 inch (0.102 cm) at a center point between the wires, and a total width of about 0.154 inch (0.391 cm). The heater was jacketed as in Example 9.

EXAMPLE 19

Using the composition of Example 12, a heater was prepared having the same geometry as Example 18.

TABLE I

CONDUCTIVE POLYMER FORMULATIONS (Components in Percent by Weight)

| Component | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| EEA | 51.7 | 43.4 | 49.6 | 47.5 | 43.4 | 35.2 | 29.3 | 24.6 | 39.0 | 31.4 | 29.6 | 26.6 | 37.4 | 35.9 | 32.8 | 29.6 | 26.6 |
| CB | 30.3 | 25.5 | 29.1 | 27.9 | 25.5 | 20.6 | 17.2 | 14.5 | 22.0 | 17.6 | 16.7 | 14.9 | 21.1 | 20.2 | 18.5 | 16.7 | 14.9 |
| MDPE | 17.2 | 14.4 | 16.5 | 15.8 | 14.4 | 11.7 | | | 38.0 | 35.0 | 28.9 | 25.8 | 36.5 | 35.0 | 31.9 | 28.9 | 25.8 |
| HDPE | | | | | | | 32.4 | 27.2 | | | | | | | | | |
| AO | 0.8 | 0.7 | 0.8 | 0.8 | 0.7 | 0.5 | 0.5 | 0.4 | 1.0 | | 0.8 | 0.7 | 1.0 | 0.9 | 0.8 | 0.8 | 0.7 |
| $Sb_2O_3$ | | 4.3 | 4.0 | 8.0 | | | | 4.3 | | 4.3 | 6.5 | 8.6 | 4.0 | 8.0 | 16.0 | | |
| ZnO | | | | | | | 20.0 | 16.8 | | | | | | | | | |
| DBDPO | | 11.7 | | | | | | 11.7 | | 11.7 | 17.5 | 23.4 | | | | 24.0 | |
| ATH | | | | | 16.0 | 32.0 | | | | | | | | | | | 32.0 |
| PA | | | | | | | 0.6 | 0.5 | | | | | | | | | |
| y/(x + y) | 0 | 0.14 | 0.12 | 0.22 | 0 | 0 | 0 | 0.23 | 0 | 0.20 | 0.28 | 0.37 | 0.16 | 0.28 | 0.46 | 0 | 0 |

Notes to TABLE I:
EEA is ethylene/ethyl acrylate copolymer.
CB is carbon black with a particle size of approximately 28 nm.
MDPE is medium density polyethylene.
HDPE is high density polyethylene.
AO is an antioxidant which is an oligomer of 4,4-thio bis(3-methyl 1-6-t-butyl phenol) with an average degree of polymerization of 3 to 4, as described in U.S. Pat. No. 3,986,981.
$Sb_2O_3$ is antimony trioxide with a particle size of 1.0 to 1.8 $\mu$m.
ZnO is zinc oxide with a particle size of 0.15 $\mu$m.
DBDPO is decabromodiphenyloxide (also known as decabromodiphenylether).
ATH is alumina trihydrate ($Al_2O_3.3H_2O$) with a particle size of 0.15 $\mu$m.
(y)/(x + y) is weight % $Sb_2O_3$/(Total weight % CB and $Sb_2O_3$).

EXAMPLES 13 TO 15

Pellets of the composition of Example 9 were preblended with $Sb_2O_3$ to give blends with the formulations listed in Table I as Examples 13, 14, and 15. Heaters were prepared and tested as in Example 12.

EXAMPLE 16

Pellets of the composition of Example 9 were preblended with DBDPO to give the blend listed in Table I as Example 16. Heaters were prepared and tested as in Example 12.

EXAMPLE 17

Pellets of the composition of Example 9 were preblended with alumina trihydrate to give the blend listed in Table I as Example 17. Heaters were prepared and tested as in Example 4.

EXAMPLE 18

The composition of Example 10 was extruded through a 1.5 inch (3.8 cm) extruder around two 22 AWG stranded

TABLE II

ARCING FAULT TEST RESULTS

| Example | Circuit Length (feet) | Fuse Response (seconds) | Burn Length (inches) | Burn Rate (in/min) |
|---|---|---|---|---|
| 1 | 2 | 97 | 2.1 | 1.30 |
| | 100 | 180 | 4.3 | 1.43 |
| 2 | 2 | 6.9 | 0 | — |
| | 50 | 8.4 | 0 | — |
| | 100 | 19 | 0.3 | 0.94 |
| 3 | 2 | 9 | 0 | — |
| 4 | 2 | 6 | 0 | — |
| 5 | 2 | 60 | 1.1 | 1.10 |
| | 100 | 159 | 3.0 | 1.13 |
| 6 | 2 | 40 | 0.8 | 1.20 |
| | 100 | * | 5.0 | — |
| 7 | 2 | 74 | 1.5 | 1.22 |
| 8 | 2 | 18 | 0.2 | 0.67 |

*The test was discontinued after 5 minutes, even though the fuse did not trip.

TABLE III

MODIFIED ARCING FAULT TEST RESULTS

| Example | Circuit Length (feet) | Amplitude of Current Spikes (amps) | Frequency of Current Spikes (#/0.5 min) | Burn Rate (in/min) |
|---|---|---|---|---|
| 1 | 2 | 31–71 | 8 | 2.06 |
| | 50 | 8–41 | 16 | 2.08 |
| | 100 | 5–21 | 34 | 2.52 |
| 2 | 2 | 27–100 | 28 | 1.83 |
| | 50 | 6–40 | 63 | 2.00 |
| | 100 | 4–30 | 88 | 2.34 |

TABLE IV

VERTICAL WIRE FLAME TEST (UL VW-1)

| Example | % Pass |
|---|---|
| 1 | 50% |
| 2 | 100 |
| 3 | 100 |
| 4 | 100 |
| 7 | 100 |
| 8 | 100 |

TABLE V

| Example | % $Sb_2O_3$ | Strip | Sample Length (feet) | Applied Voltage (volts) | Arc Propagation | Flame Length (inch) | Current Spike Rate |
|---|---|---|---|---|---|---|---|
| 9 | 0 | Std.+ | 2 | 120 | Yes | 1–2 | Low |
| | | | 100 | 120 | Yes | 1–2 | |
| 10 | 4.3 | Std.+ | 2 | 120 | Yes | 1–2 | High |
| | | | 100 | 60 | No | | |
| | | | 100 | 70 | No* | | |
| | | | 100 | 80 | Yes | 3 | |
| | | | 100 | 90 | Yes | 2 | |
| | | | 100 | 100 | Yes | 2 | |
| | | | 100 | 120 | Yes | 2 | |
| 11 | 6.5 | Std.+ | 100 | 120 | Yes | | High |
| 12 | 8.6 | Std.+ | 2 | 120 | No | | High |
| | | | 100 | 60 | No | | High |
| | | | 100 | 70 | No | | High |
| | | | 100 | 80 | No | ** | High |
| | | | 100 | 90 | No | ** | High |
| | | | 100 | 100 | No | ** | High |
| | | | 100 | 120 | No | | High |
| 13 | 4.0 | Std.+ | 100 | 120 | Yes | | High |
| 14 | 8.0 | Std.+ | 100 | 120 | Yes | | High |
| 15 | 16.0 | Std.+ | 100 | 120 | Yes | | High |
| 16 | 0 | Std.+ | 100 | 120 | Yes | | Low |
| 17 | 0 | Std.+ | 100 | 120 | Yes | | Low |
| 18 | 4.3 | DB+ | 2 | 120 | No | | |
| | | | 75 | 120 | Yes | | |
| | | | 100 | 120 | Yes | | |
| 19 | 8.6 | DB+ | 2 | 120 | No | | |
| | | | 100 | 120 | No | | |

Notes to TABLE V:
*Will not sustain an arc
**Product sustained an arc for 6 to 16 seconds but there was no sustained flame.
+Std. indicates "standard" oval geometry; DB indicates "dogbone" geometry.

What is claimed is:

1. A strip heater circuit which comprises (1) a strip heater which comprises (a) a resistive element which is composed of a conductive polymer composition which comprises (i) a polymer, (ii) a particulate conductive filler, (iii) a particulate nonconductive filler, and (iv) a flame retardant, and (b) two elongate wire electrodes which can be connected to a source of electrical power to cause current to flow through the resistive element, (2) a power supply electrically connected to the strip heater, and (3) a first fuse which (a) is a very fast acting fuse, and (b) is electrically connected to the strip heater and the power supply, wherein the heater is such that when tested in a standard arc propagation test, it will not propagate an arc.

2. A strip heater circuit according to claim 1 wherein the first fuse is part of a fused plug assembly.

3. A circuit according to claim 1 wherein the first fuse is an independent component in the circuit.

4. A circuit according to claim 1 wherein the circuit further comprises a resistor, a thermostat, a circuit protection device, or a indicating light electrically connected to the strip heater, the power supply and the first fuse.

5. A circuit according to claim 1 wherein the conductive filler comprises carbon black.

6. A circuit according to claim 1 wherein the nonconductive filler comprises an inorganic oxide.

7. A circuit according to claim 6 wherein the inorganic oxide comprises $Sb_2O_3$.

8. A strip heater assembly which comprises (A) a strip heater which comprises (1) a resistive element which is composed of a first conductive polymer composition which comprises (a) a polymer, (b) a particulate conductive filler, and (c) a particulate nonconductive filler, and (2) two elongate metal electrodes which can be connected to a source of electrical power to cause current to flow through the resistive element, and (B) a first fuse which (a) is a very fast acting fuse, and (b) is electrically connected to the strip heater, the particulate nonconductive filler being such that when the first composition is made into a standard strip heater I and the standard heater I is tested in a standard arcing fault test in a circuit comprising a second fuse which is a very fast acting 10 A, 120/250V fuse, it trips the second fuse in less than 30 seconds.

9. An assembly according to claim 8 wherein the first fuse is connected between the two electrodes.

10. An assembly according to claim 8 wherein the first fuse is part of a fused plug assembly.

11. A strip heater circuit which comprises (1) a strip heater which comprises (a) a resistive element which is composed of a conductive polymer composition which comprises (i) a polymer, (ii) a particulate conductive filler, and (iii) a particulate nonconductive filler, and (b) two elongate wire electrodes which can be connected to a source of electrical power to cause current to flow through the resistive element, (2) a power supply electrically connected to the strip heater, and (3) a first fuse which (a) is a very fast acting fuse, and (b) is electrically connected to the strip heater and the power supply, wherein the particulate nonconductive filler is such that when the composition is made into a standard strip heater I and the standard strip heater I is tested in a standard arcing fault test in a circuit comprising a second fuse which is a very fast acting 10 A, 120/250V fuse, it trips the second fuse in less than 30 seconds.

12. A strip heater circuit according to claim 11 wherein the first fuse is part of a fused plug assembly.

13. A circuit according to claim 11 wherein the first fuse is an independent component in the circuit.

14. A circuit according to claim 11 wherein the circuit further comprises a resistor, a thermostat, a circuit protection device, or a indicating light electrically connected to the strip heater, the power supply and the first fuse.

15. A circuit according to claim 11 wherein the conductive filler comprises carbon black.

16. A circuit according to claim 11 wherein the nonconductive filler comprises an inorganic oxide.

17. A circuit according to claim 16 wherein the inorganic oxide comprises $Sb_2O_3$.

18. A strip heater circuit which comprises (1) a strip heater which comprises (a) a resistive element which is composed of a conductive polymer composition which comprises (i) a polymer, (ii) a particulate conductive filler, (iii) a particulate nonconductive filler, and (iv) a flame retardant, and (b) two elongate wire electrodes which can be connected to a source of electrical power to cause current to flow through the resistive element, (2) a power supply electrically connected to the strip heater, and (3) a first fuse which (a) is a very fast acting fuse, and (b) is electrically connected to the strip heater and the power supply, wherein the conductive polymer composition is such that when it is made into a standard strip heater II and the standard strip heater II is tested in a standard arc propagation test, an arc will not propagate.

19. A strip heater circuit according to claim 18 wherein the first fuse is part of a fused plug assembly.

20. A circuit according to claim 18 wherein the first fuse is an independent component in the circuit.

21. A circuit according to claim 18 wherein the circuit further comprises a resistor, a thermostat, a circuit protection device, or a indicating light electrically connected to the strip heater, the power supply and the first fuse.

22. A circuit according to claim 18 wherein the conductive filler comprises carbon black.

23. A circuit according to claim 18 wherein the nonconductive filler comprises an inorganic oxide.

24. A circuit according to claim 23 wherein the inorganic oxide comprises $Sb_2O_3$.

* * * * *